US006109084A

United States Patent [19]

Hutzenlaub et al.

[11] Patent Number: 6,109,084

[45] Date of Patent: Aug. 29, 2000

[54] DEVICE FOR STRETCHING THIN METAL STRIPS BY TRACTION

[75] Inventors: Armin Hutzenlaub, Wiehl; Paulus Heister, Engelkirchen, both of Germany

[73] Assignee: Kampf GmbH & Co. Maschinenfabrik, Wiehl, Germany

[21] Appl. No.: 09/284,314

[22] PCT Filed: Oct. 24, 1997

[86] PCT No.: PCT/EP97/05875

§ 371 Date: Apr. 27, 1999

§ 102(e) Date: Apr. 27, 1999

[87] PCT Pub. No.: WO98/19804

PCT Pub. Date: May 14, 1998

[30] Foreign Application Priority Data

Nov. 6, 1996 [DE] Germany ..... 196 45 599

[51] Int. Cl.[7] ..... B21B 39/08

[52] U.S. Cl. ..... 72/205

[58] Field of Search ..... 72/160, 161, 164, 72/205

[56] References Cited

U.S. PATENT DOCUMENTS

| | | | |
|---|---|---|---|
| 4,408,474 | 10/1983 | Hutzenlaub et al. | 72/205 |
| 4,765,169 | 8/1988 | Bradlee | 72/160 |
| 4,819,470 | 4/1989 | Noe' et al. | 72/205 |

FOREIGN PATENT DOCUMENTS

| | | | |
|---|---|---|---|
| 1 483 386 | 6/1967 | France . | |
| 1 552 012 | 11/1976 | Germany . | |
| 25 29 899 | 1/1977 | Germany . | |
| 30 26 129 A1 | 2/1982 | Germany . | |
| 39 12 676 A1 | 10/1990 | Germany . | |
| 2 142609 | 5/1990 | Japan | 72/205 |
| 1 219 966 | 1/1971 | United Kingdom . | |

OTHER PUBLICATIONS

Abstract–Pub–No: DE 25 29 899 C1 to Armin Hutzenlaub, Jan. 13, 1977.

*Primary Examiner*—Rodney A. Butler
*Attorney, Agent, or Firm*—Herbert Dubno; Andrew Wilford

[57] ABSTRACT

An apparatus for stretch leveling thin metal strips, in particular aluminum strips between 0.1 and 0.5 mm thick, has a group of braking rollers that are interconnected via differential transmissions and controlled jointly with respect to speed to form a first leveling path with a downstream central speed-controlled leveling roller and that downstream a group of pulling rollers connected together by means of differential transmissions and controlled jointly with respect to speed form a second leveling path with the central leveling roller.

3 Claims, 2 Drawing Sheets

DEVICE FOR STRETCHING THIN METAL STRIPS BY TRACTION

CROSS REFERENCE TO RELATED APPLICATIONS

This application is the US national phase of PCT application PCT/EP97/05875 filed Oct. 24, 1997 with a claim to the priority of German application 196 45 599.5 filed Nov. 6, 1996.

FIELD OF THE INVENTION

The inventions relates to an apparatus for stretch leveling thin metal strips, in particular aluminum strips having a thickness between 0.1 and 0.5 mm.

BACKGROUND OF THE INVENTION

To continuously level thin metal strips two processes are known: With stretch leveling a free length of the metal strip is tensioned between two roller pairs with a force exceeding its yield limit so as to be plastically lengthened. With stretch bending a strip pretensioned below its yield limit is deflected about rollers of small diameter so that the bending subjects the outer surface to an additional tension. The bending tension combined with the prestress creates a plastic lengthening of the strip that takes place on the upper and lower faces as the strip is looped back and forth.

Stretch bending is likely to mar the surface from the many contacts with the small rollers that are normally made of steel. This method is thus disadvantageous when strips with a high surface quality are needed, e.g. for lithographic purposes.

German patent 3,525,343 describes the advantages and disadvantages of the two leveling methods and advises for thin metal strips, e.g. aluminum strips 0.1 to 0.33 mm thick, a combination of the two methods.

German patent 3,912,676 describes an apparatus of this type that works according to the principles of pure stretch leveling. Between a set of torque-controlled braking rollers and a set of torque-controlled driven rollers is a rotation-controlled pair of leveling rollers by means of which the strip is subjected to the necessary stretching to plastically deform it.

It is recognized—as described in German patent 3,912,676—that with each lengthening, whether elastic or plastic, there is a transverse contraction. With metal strips the ratio of longitudinal stretch to transverse contraction, the Poisson number, is about 0.3; that is the width change is about one-third of the length change. It has been proven that the planarity during leveling is damaged when the transverse shrinkage is impeded by the strip sticking to the retaining rollers. Only in the free stretches between two succeeding rollers can the strip draw together unhindered transversely.

OBJECT OF THE INVENTION

It is an object of the invention to provide a stretch-leveling apparatus that can produces strips of extremely high quality.

SUMMARY OF THE INVENTION

An apparatus for stretch leveling thin metal strips, in particular aluminum strips between 0.1 and 0.5 mm thick, has a group of braking rollers that are interconnected via differential transmissions and controlled jointly with respect to speed to form a first leveling path with a downstream central speed-controlled leveling roller and that downstream a group of pulling rollers connected together by means of differential transmissions and controlled jointly with respect to speed form a second leveling path with the central leveling roller.

The apparatus according to the invention does stretch leveling in two stages. The strip thus has several opportunities to draw together transversely during the leveling in free strip stretches.

BRIEF DESCRIPTION OF THE DRAWING

The drawing serves to show the invention with reference to a simplified illustrated embodiment wherein.

EMBODIMENTS OF THE INVENTION

Figure 1:
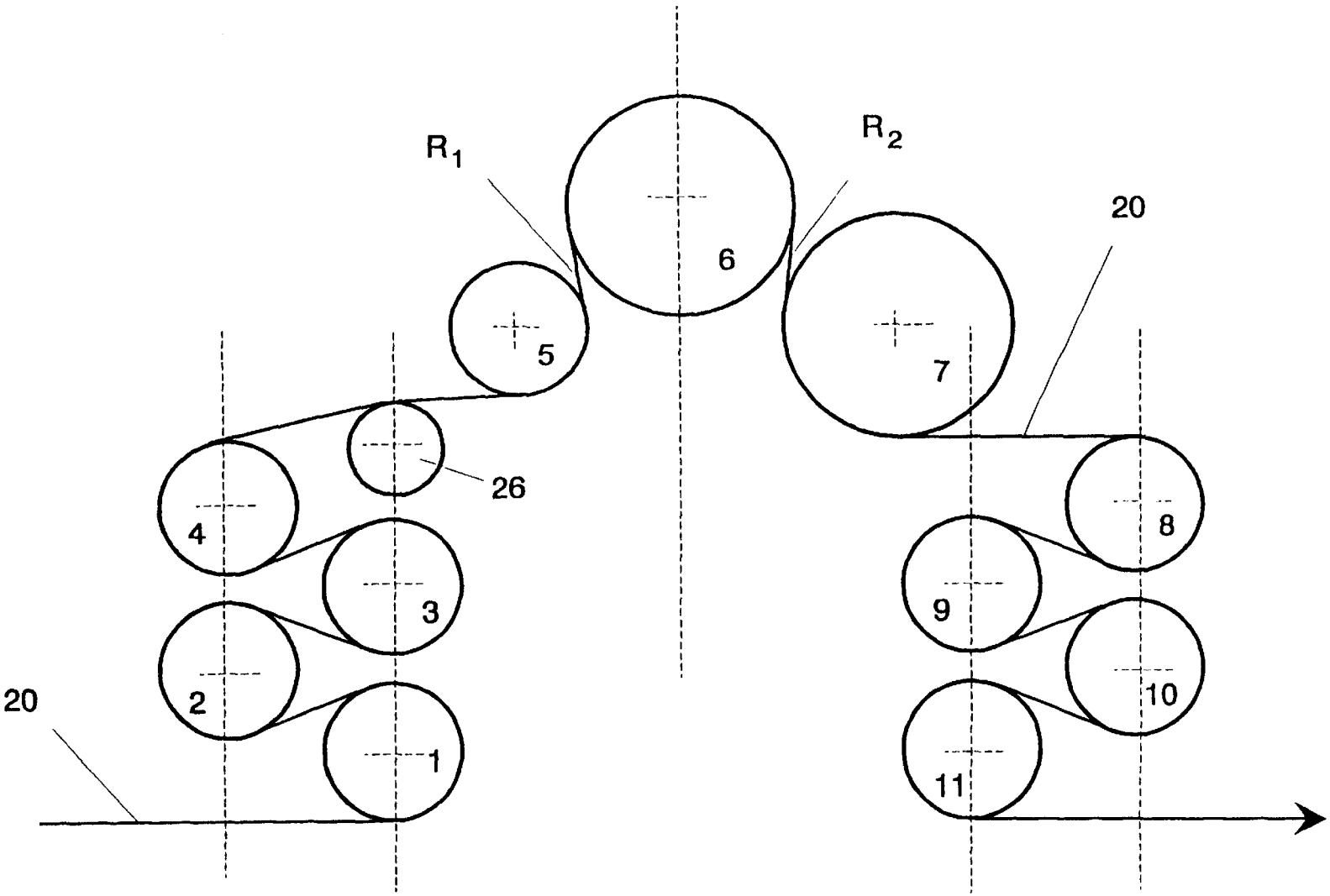
FIG. 1 is a side view of the main elements.

The apparatus serves for stretch leveling thin metal strips, preferably aluminum strips between 0.1 and 0.5 mm thick. It is comprised of a group—here five—of braked rollers 1–5 that are all connected together via differential transmissions 12–16 and controlled jointly with respect to speed. The distribution of the braking torque in the individual rollers 1–5 takes place in the known manner corresponding to the desired force increase between the strip 1 and the individual rollers 1–5 as for example shown in FIG. 2 of German patent 2,529,899. Subsequently there is a central leveling roller 6 that is connected with a drive motor 18. The drive motor 18 is controlled with respect to speed and determines the speed of the leveling apparatus.

Downstream of the central leveling roller 6 is a group of five pulling rollers 7–11 which also are connected together via differential transmissions 21–25 and are controlled jointly with respect to speed. The distribution of the stretching torques takes place in the same manner as the distribution of the braking torques with the rollers 1–5. The pulling rollers 7–11 are also connected for driving with the central leveling roller 6.

There are thus two leveling paths: On the one hand there is the leveling path $R_1$ between the central leveling roller 6 and the last braking roller 5, and on the other hand the leveling stretch $R_2$ between the central leveling roller 6 and the first pulling roller 7. This arrangement serves for two-stage leveling. The amount of leveling of the first leveling stage in the path $R_1$ is controlled by the adjustable and constant speed ratio of the motors 17 and 18. Similarly there is an adjustable and constant speed ratio of the motors 18 and 19 that determines the amount of leveling of the second stage in the path $R_2$.

Figure 2:
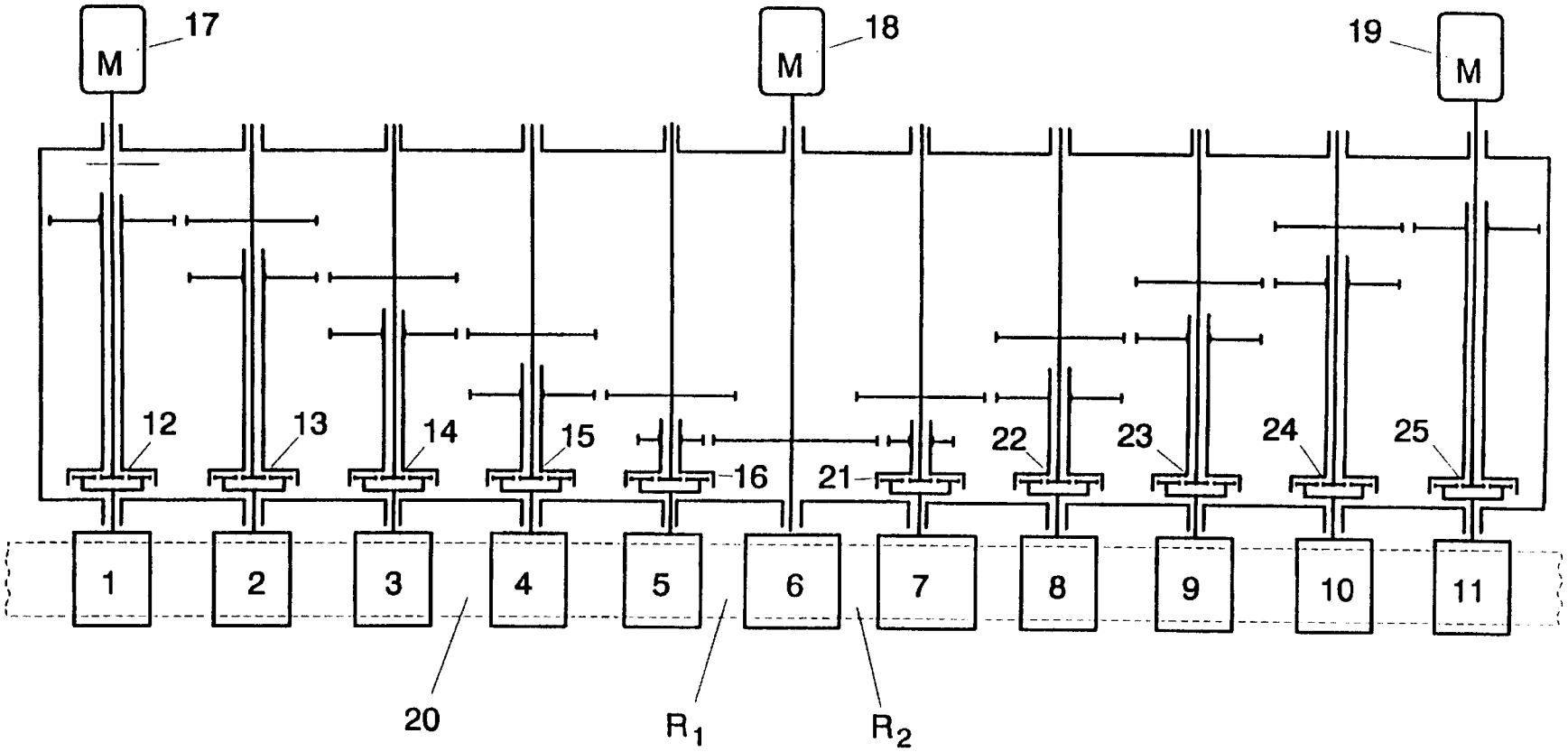
FIG. 2 is a schematic top view of the drive system.

Preferably the group of pulling rollers 7–11 is generally symmetrical to the group of braking rollers 1–5 relative to the central leveling roller 6 and is arranged as shown in FIGS. 1 and 2. This arrangement simplifies the construction and control of the leveling apparatus.

The two rollers 6 and 7 which define the downstream ends of the leveling paths $R_1$ and $R_2$ have a larger diameter than the other rollers 1–5 and 8–11 as shown in FIG. 1. In this manner the stretching of the outer surface of the strip 10 as a result of the curvature when looping at the ends of the paths $R_1$ and $R_2$ is kept small.

Both the last free shaft of the differential transmission 12 of the first braking roller 1 and the last free shaft of the differential transmission 25 of the last pulling roller 11 are connected to the respective drive motors 17 and 19. The drive motors 17 and 19 serve for tensioning the strip between the rollers 1–5 and 7–11 and for tensioning the individual groups relative to the central leveling roller 6.

The maximum difference of the torques of the drive motors 17 and 19 of the braking group is limited such that the holding power between the central roller 6 and the strip 20 is not exceeded. Thus a slipping of the strip 20 on the central roller 5 is impossible. Since a slipping of the strip 20 on the other rollers 1–11 is also technically impossible, the amount of leveling in the two leveling stages is established by an adjustable and constant rotation ratio of the drive motors 17, 18 and 18, 19.

Between the two last braking rolls 4 and 5 is a tension-measuring roller 26. It serves to determine the instantaneous tension at this point in the path of the strip. The measurement is used to automatically determine the necessary braking force before the first roller 1 and the necessary pulling after the last roller 11.

What is claimed is:

1. An apparatus for stretch-leveling an elongated and thin metal strip beyond its elastic limit, the apparatus comprising:

a group of downstream braking rollers, the strip passing between and around the braking rollers without slip;

respective differential transmissions interconnecting the braking rollers;

a central leveling roller, the strip passing around the leveling roller after leaving the braking rollers;

a group of upstream pulling rollers, the strip passing between and around the pulling rollers after leaving the leveling roller without slip;

respective differential transmissions interconnecting the pulling rollers; and drive means connected to the downstream rollers, leveling roller, and upstream rollers for rotating the downstream rollers at a slower peripheral speed than the leveling roller and for rotating the upstream rollers at a faster peripheral speed than the leveling roller, whereby the strip is stretch leveled beyond its elastic limit as it passes from the braking rollers to the leveling roller and as it passes from the leveling roller to the pulling rollers.

2. The stretch-leveling apparatus defined in claim 1 wherein the group of pulling rollers is generally symmetrical to the group of braking rollers with respect to the central leveling roller.

3. The stretch-leveling apparatus defined in claim 1 wherein the drive means rotates the leveling roller at such a peripheral speed that the strip does not slip on it.

* * * * *